United States Patent [19]

Schuller

[11] 3,989,288

[45] Nov. 2, 1976

[54] DOOR LOCK FOR RAILWAY CAR SLIDING DOORS

[75] Inventor: James J. Schuller, Crete, Ill.

[73] Assignee: Pullman Incorporated, Chicago, Ill.

[22] Filed: May 27, 1975

[21] Appl. No.: 581,404

[52] U.S. Cl. ..... 292/213; 292/DIG. 32; 292/218

[51] Int. Cl.[2] ..... E05C 19/08

[58] Field of Search ..... 292/218, DIG. 32, 104, 292/205, 282, 281, 327, 213, 120

[56] References Cited

UNITED STATES PATENTS

| | | | |
|---|---|---|---|
| 368,657 | 8/1887 | Elkins | 292/136 |
| 1,095,792 | 5/1914 | Bohan | 292/104 |
| 1,469,719 | 10/1923 | Dobson | 292/DIG. 32 |
| 1,691,028 | 11/1928 | Axelson | 292/104 |
| 2,297,977 | 10/1942 | Osner | 292/DIG. 32 |

*Primary Examiner*—Richard E. Moore
*Attorney, Agent, or Firm*—Richard J. Myers

[57] ABSTRACT

A railway car door arrangement is provided with a lock mechanism positioned toward the upper ends of the doors so as to be remote from the track level and thus will discourage pilferage. The mechanism includes a hasp which is pivotally mounted for swinging movement on a projecting portion of a door and which is engageable with a keeper socket supported either on an adjacent door, in the case of a two-door arrangement, or on the door frame of the box car side wall. The keeper includes a socket for receiving an end portion of a hasp and suitable locking projections are adapted to receive a cable or lock for further locking the hasp in closed position.

4 Claims, 3 Drawing Figures

DOOR LOCK FOR RAILWAY CAR SLIDING DOORS

REFERENCE TO RELATED PATENT APPLICATION

This application is related to patent application Ser. No. 581,193 filed May 27, 1975 and Ser. No. 590,775 filed June 27, 1975.

BACKGROUND OF THE INVENTION

1. Field of the Invention

The present invention relates to the railway art particularly to box car sliding doors. More specifically, it relates to an improved lock which is adapted to be positioned in a manner and constructed to discourage pilferage of the contents of the car.

2. Description of the prior art

The prior art exemplified in U.S. Pat. No. 3,788.007 patented Jan. 29, 1974 discloses conventional hasp and lock arrangements which are positioned at the lower portions of the door so as to be readily accessible to railroad personnel standing at the level of the track. Such conventional locks are disclosed in U.S. Pat. Nos. 2,715,539 Aug. 16, 1955, 2,740,154 Apr. 3, 1956 and 2,780,180 Feb. 5, 1957.

SUMMARY OF THE INVENTION

The present invention has as its prime object the provision of a lock for railway car doors which is remotely positioned so as to discourage pilferage from the railway car. The lock is positioned at a height sufficiently high to be out of the reach of a person standing at track level and is so constructed to be rugged and simple, yet sufficiently difficult to open except by authorized persons who may be present when the door opening is placed at the level of a dock at the loading area. In the present invention the housing is provided with a vertical socket which is supported either on an adjacent door or the side wall of a car, the said socket having an opening facing longitudinally outwardly. A hasp is swingably mounted on the door and includes a narrow portion adapted to be received and extend through the socket opening or slot when the hasp is pivoted to a closed position. The hasp includes an enlarged end which has an arcuate configuration conforming to the arcuate walls of the socket. Locking projections are provided which are so disposed as to be substantially inaccessible and difficult to remove by the unauthorized person who may be standing at track level.

DESCRIPTION OF THE PREFERRED EMBODIMENT

Figure 1:
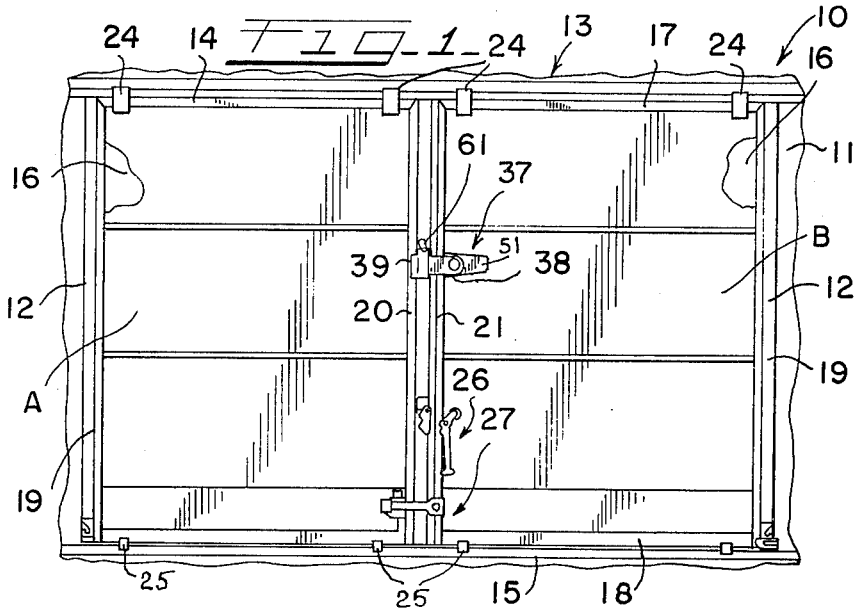
FIG. 1 is a side elevational view of a railway car side having a door opening and showing a double door arrangement with an improved anti-pilferage lock arrangement.

Referring to FIG. 1, the railway car body generally designated at 10 includes a side wall 11 provided with horizontally spaced vertical door posts 12. The door posts 12 are connected at their upper ends to a horizontal door plate or header 13 including an upper track 14. A lower track 15 is disposed below a door opening 16 provided in the side wall 11. Sliding doors A and B are disposed over the door opening 16 and each includes upper and lower frame members 17 and 18. The upper and lower members 17 and 18 are connected by vertical end frame members 19. The inner ends of the doors A and B are provided with centrally located frame members designated at 20 and 21 and are respectively provided with door sheathing 22 and 23. The doors A and B are slideable relative to the upper track 14 and include safety hangers 24 of conventional design. The lower portions of doors A and B are provided with conventional rollers (not shown) slidingly supporting them on the lower track 15. Also retainers 25 are provided. The doors are also provided with a conventional starter and closure lever arrangement 26 and a hasp type lock 27.

Figure 3:
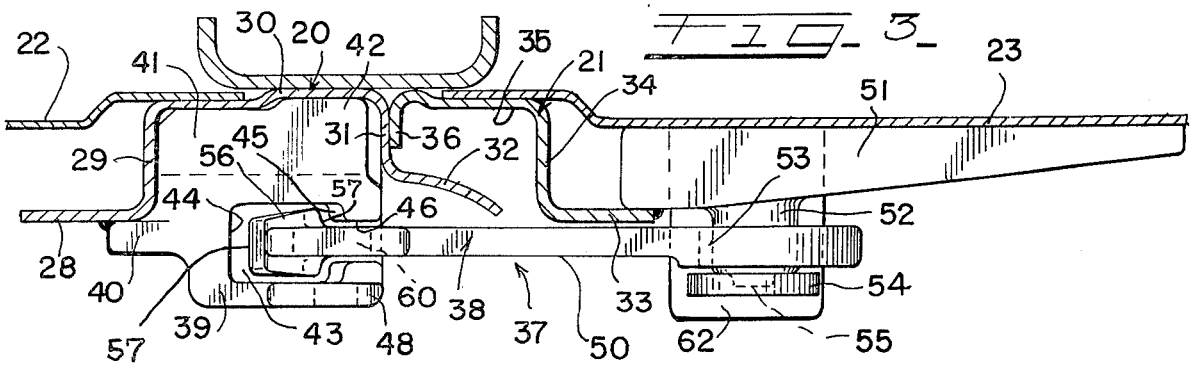
FIG. 3 is a cross sectional view taken substantially along the line 3—3 of FIG. 2.

The doors A and B may be slidingly moved apart to opposite sides of the door opening. As best shown in FIG. 3, the centrally located frame member 20 is provided with an outer parallel flange 28 integral with a laterally extending flange 29 which is connected to a longitudinal base portion 30. An abutment flange 31 extends laterally outwardly from the base portion 30 and includes an arcuate weather seal end flange 32.

The centrally located frame member 21 includes an outer longitudinal flange 33, a lateral flange 34, and a longitudinal flange 35 which is connected to the end of door sheathing 23. The longitudinal flange 35 also includes an outwardly projecting abutting flange 36 which, as shown in FIG. 3, is in engagement with the abutment flange 31 during the closed position of the door.

Figure 2:
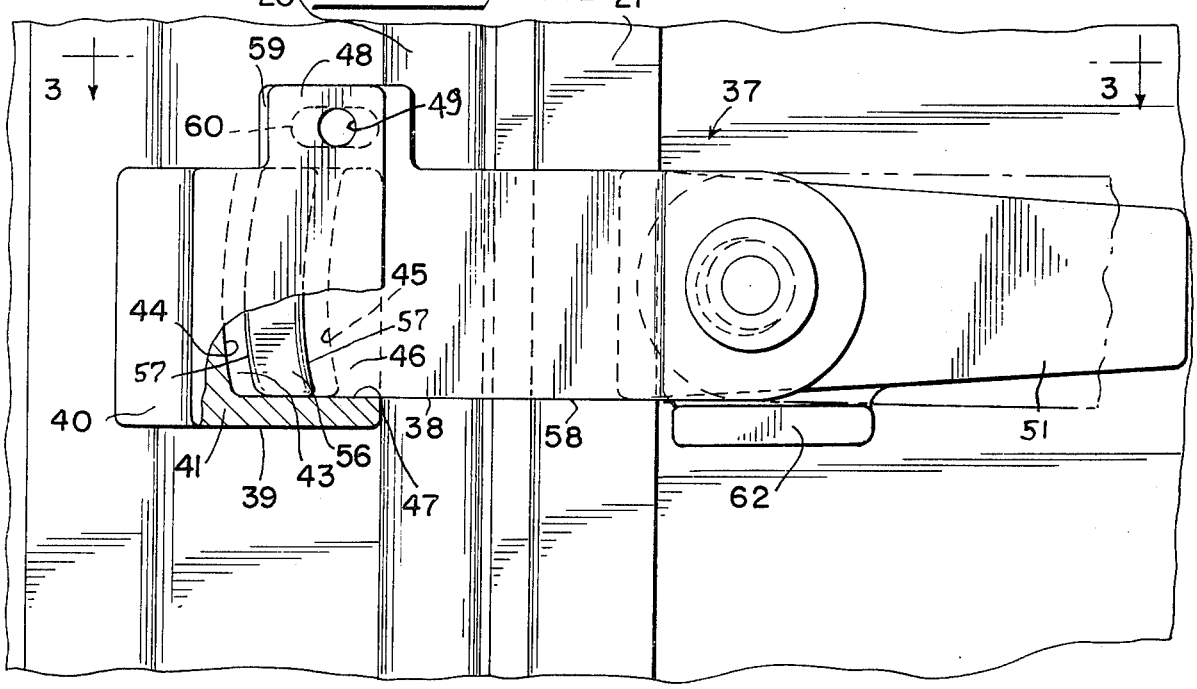
FIG. 2 is an enlarged view of the lock arrangement of FIG. 1.

An anti-pilferage lock is generally designated by the reference character 37 and includes a hasp 38 and a keeper casting or housing 39 having a projecting tab 40 securely connected to the flange 28. The keeper 39 also includes a central body portion 41 having a vertical attaching portion 42 securely connected to the flange 30 of the frame member 20. The keeper 39 also includes a vertical pocket or socket 43 provided with vertical arcuate walls or surfaces 44 and 45. A slot 46 open at both sides is provided in the body portion 41 of the keeper. As best shown in FIG. 2, the slot 46 terminates at the lower end of the keeper 39 in the form of a ledge or stop wall 47. An upwardly extending locking tab or projection 48 is integral with the keeper body 41 and includes a lateral extending opening 49. In a single door arrangement the keeper is positioned on the car side wall with the hasp on the door. In a two door arrangement as shown, the keeper is positioned on the left hand door (A) and the hasp on the right hand door (B). The hasp 38 includes a relatively slender body portion 50 and is supported on a pivot bracket 51 rigidly connected to the front face of the sheathing 23. A pivot boss 52, projects through a bore 53 of the hasp 38, for pivotally supporting the same thereon. A lock washer or plate 54 is secured to a connector projection 55 extending outwardly from the boss 52, thereby securing the plate 50 against outward lateral movement. The other end of the plate 50 includes a locking head 56 having surfaces 57 complementary to the surfaces 44 and 45. As indicated in FIG. 2, the lower edge 58 of the hasp is adapted to be seated upon the stop or ledge 47 in the closed position. The plate 50 also includes a locking projection or tab 59 having an opening or slot 60 through which a cable or lock 61, disclosed in FIG.

1, is adapted to be placed through the opening 49 for effectively locking the doors A and B together. As best shown in FIG. 2, a ledge 62 projects outwardly from the pivot bracket 51 and provides a supporting surface for the hasp 38 when the same is moved to the dotted line or unlocked position shown in FIG. 2 or upon the door being in an open position.

Operation of the starter mechanism 26 and hasp 27 are of course conventional in the art. FIG. 2 discloses the lock in a locked position wherein the hasp 58 is in lock condition relative to the keeper 41. The cable or lock 61 is through the opening 49 and slot 60 and thus the lock mechanism, by virtue of its high location on the door is disposed in a manner wherein unauthorized persons standing at track level are discouraged from trying to open the same.

While the lower lock 27 could be pried open by thieves standing at the track level, it is much more difficult to reach the anti-pilferage lock 37 without the use of ladders, and similar equipment. Most pilferage and unauthorized entry occurs from track level while the cars are standing in the yard, rather than adjacent to loading docks. Thus while the improvement discourages unauthorized entry, the present lock can easily be reached from a loading dock which is generally at the level of the floor of the car or at the lower end of the door opening. It is also a simple matter for the pilferage lock to be swung to the out-of-the-way open position shown in broken lines in FIG. 2 wherein the same rests upon the ledge 62.

What is claimed is:

1. In a railway car having a side wall element with a door opening, a door element supported on the side wall element for movement between open and closed positions, a latch extending between said elements including a horizontal pivot mounted on one of said elements, a hasp member connected to the pivot member for vertical swinging movement thereabout and having a body with a head at one end, a socket member on the other element having an upwardly open pocket for receiving said head of the hasp therein, said socket member having a first vertical wall with a vertical slot therein open upwardly and into the socket member and to the exterior and positioned to accommodate passage of a portion of the body adjacent to the head therein, said slot dividing said first wall into inboard and outboard portions, said socket member having a second vertical wall spaced laterally of the first wall and defining the opposite side of the socket widthwise of the latch, said walls having opposing arcuate interior concentric abutment surfaces generated from the axis of said pivot member, said head having edge portions with arcuate abutment surfaces opposing respective arcuate surfaces on said walls and complimental thereto, a lug on each member having openings alignable in the locked position thereof adapted to receive securing means therethrough, said surfaces providing means resisting vertical displacement of said hasp member in the locked position thereof during car movement tending to move the door back and forth thereby essentially eliminating shearing loads acting through said lugs on said securing means, said head being substantially centered lengthwise on said body and said edge portions thereof projecting beyond opposite sides of the body, and said inboard and outboard wall portions being disposed in opposition to and engageable with the respective portions of the head.

2. In a railway car having a side wall member with a door opening, a door member slidably mounted on the car for slidable movement horizontally from one side of the opening to covering relationship thereto and vice versa, an anti-pilfering latch extending between the door member and said side wall member comprising:

a hasp having a head, a substantially horizontal pivot on one of said members mounting said hasp, a socket member mounted on the other member in generally horizontal alignment with the pivot of the hasp and having an upwardly open pocket for admitting the head of the hasp, said socket having a wall adjacent to the pivot of the hasp with a vertical slot therein open at its upper edge and extending widthwise from the pocket to the exterior of the socket for admitting said body portion attendant to said head being positioned in the pocket, said head and socket having opposing concentric arcuate surfaces lengthwise of the hasp defined from said pivot, the crest of curvature of said surfaces being substantially in longitudinal alignment with the longitudinal axis of said body portion in the locked position whereby said surfaces resist vertical displacement of said hasp upon longitudinal movement of the door during transit, securing means on the socket and hasp having alignable apertures in the locked position of the latch for receiving fastening means therethrough, said surfaces on the socket and the head extending at opposite sides of the slot for simultaneous engagement during relative separating movement of the socket and hasp.

3. The invention according to claim 2 and said side wall member having an indentation in the external side thereof of U-shaped cross-sectional configuration, and said socket portion having an inboard portion nested within said indentation and closely confined therein whereby said slot and hasp are disposed in non-obstructive position close to the exterior of said side wall.

4. The invention according to claim 2 and said apertures extending widthwise through said hasp and socket member and one of said apertures being laterally enlarged relative to the other aperture thereby substantially obviating severance of the fastening means during transit between said hasp and socket portion.

* * * * *